United States Patent [19]

Aguiar

[11] 4,212,586

[45] Jul. 15, 1980

[54] TURBOEXHAUST HUB EXTENSION FOR A MARINE PROPELLER

[76] Inventor: Mervyn F. Aguiar, 623 Plumas Ct., Martinez, Calif. 94553

[21] Appl. No.: 964,597

[22] Filed: Dec. 19, 1978

[51] Int. Cl.[2] ..... B63H 1/16; B63H 1/18

[52] U.S. Cl. ..... 416/93 A

[58] Field of Search ..... 115/34 R; 416/193 R, 416/93 A, 93 M, 93 R, 171

[56] References Cited

U.S. PATENT DOCUMENTS

| | | | |
|---|---|---|---|
| 2,948,252 | 8/1960 | Alexander, Jr. | 416/93 |
| 3,092,185 | 6/1963 | Alexander, Jr. | 416/93 |
| 3,246,698 | 4/1966 | Kiekhaefer | 416/93 |
| 3,279,415 | 10/1966 | Kiekhaefer | 416/93 |
| 3,554,665 | 1/1971 | Lorenz et al. | 416/93 |
| 3,567,334 | 3/1971 | Lorenz | 417/93 |
| 3,589,833 | 6/1971 | Lancioni | 416/93 |

*Primary Examiner*—Everette A. Powell, Jr.
*Assistant Examiner*—A. N. Trausch, III
*Attorney, Agent, or Firm*—Phillips, Moore, Weissenberger, Lempio & Majestic

[57] ABSTRACT

An improvement to a marine propeller in which engine exhaust gases are discharged through the hub consists of an extension formed with inwardly projecting helical fins. The extension is adapted for mounting on the propeller distal of the shaft end of the hub.

5 Claims, 4 Drawing Figures

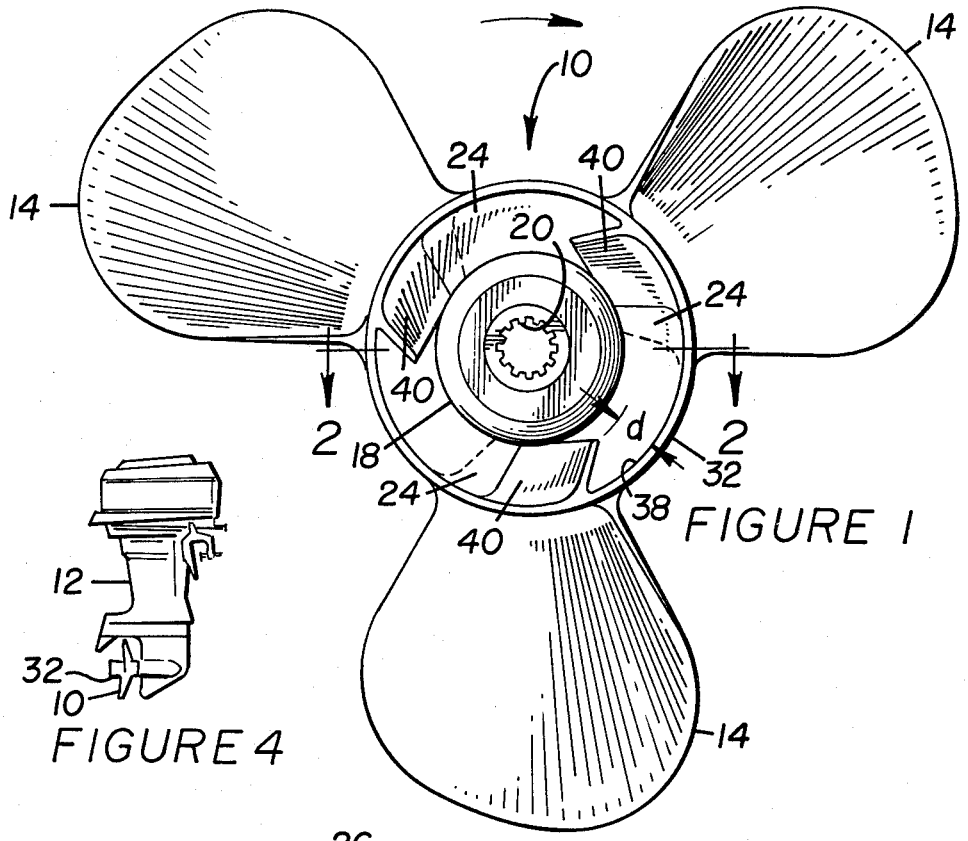
FIGURE 1
FIGURE 4
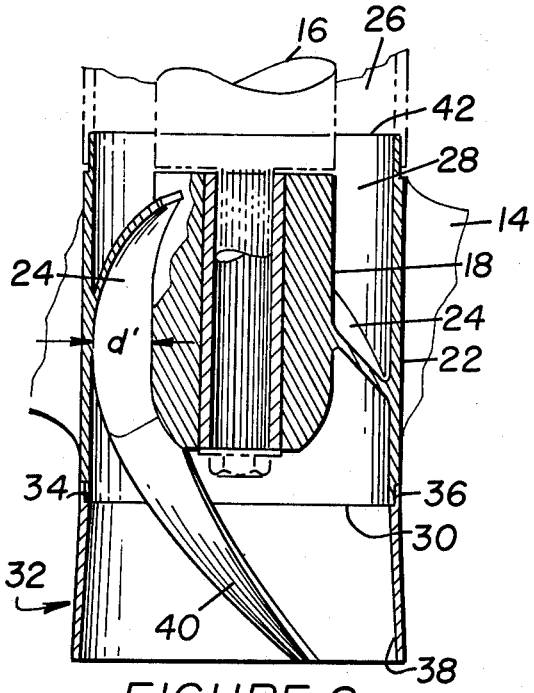
FIGURE 2
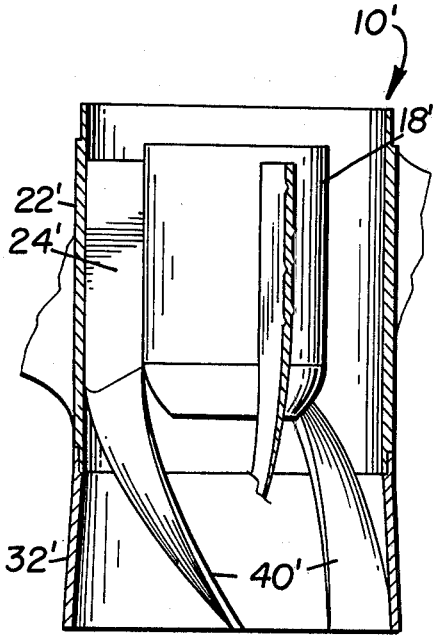
FIGURE 3

TURBOEXHAUST HUB EXTENSION FOR A MARINE PROPELLER

BACKGROUND OF THE INVENTION

This invention relates to boat propellers. In particular it relates to those particular type of boat propellers in which engine exhaust gases are discharged through the hub of the propeller.

It is common practice in certain classes of engine driven small boats to discharge gases from internal combustion engines through the hub of the propeller. Such a scheme is advantageous in that exhaust gases are dissipated into the water environment rather than the atmosphere. By so discharging the gases, a certain degree of muffling is obtained. Furthermore the necessity for shielding hot exhaust system is, to a great extent, obviated.

The design of the internal exhause porting in the engine, particularly outboard engines, is well known in the art and it will not be discussed further in this disclosure except for the following remarks. Such systems are found, for example, in the so called outboard motors which are mountable on the transom of small boats. Such boat engines are rotatable about a vertical axis thus obviating the need for a rudder normally found in a so called inboard motor. Exhaust gases from the motor are directed downwardly through a vertical housing parallel to the drive shaft. At the base of the housing, some several inches underwater, the shaft is terminated with a bevel gear which in turn drives a relatively horizontal gear shaft, the shaft having affixed at one end the boat propeller. Similarly the exhaust gases are turned 90° and directed to a concentric passageway located about the propeller shaft. The propeller is formed with a central hub structure, usually splined, which is affixed to the propeller shaft. The propeller is held on the shaft by a conventional nut at the end distal of the engine housing. Exhaust gases are passed into a blade mounting structure or hub affixed about the central hub by radiating projections or vanes. This outer or mounting hub carries the individual propeller blades. Exhaust gases pass through the annular chamber formed between the central hub and the outer mounting hub to be discharged along the axis of the propeller. Various schemes have been disclosed to reduce back pressure of the exhaust gases which could adversely affect engine operation. Vanes located between the central hub and the outer hub have generally taken the form of either straight through vanes or in some cases helical vanes. The ultimate goal of the vanes within the propeller has been to reduce back pressure in the exhaust system. There have been attempts to flare the propeller hub thus reducing pressure by the venturi effect within the propeller itself. In no case has there been any effort to retrieve or recover any power inherent in the flow of exhaust gases outwardly of the propeller hub.

Accordingly this invention is an extension to a marine propeller in which exhaust gases discharge through the hub. An annular ring is adapted to be received about the hub of a marine propeller distal of the drive shaft. The annular ring has an inside dimension proximal the hub substantially equal the inside dimension of the hub and an inside dimension distal of the hub at least equal to the inside dimension of the hub. The annular ring extension has at least two inwardly projecting helical fins upon which exhaust gases may impinge.

BRIEF DESCRIPTION OF THE DRAWINGS

FIG. 1 is a rear elevation view of a marine propeller having the extension envisioned by this invention affixed thereto.

FIG. 2 is a sectional view taken at line 2—2 of FIG. 1 showing the extension affixed to the propeller.

FIG. 3 is the same extension affixed to a different form of a propeller.

FIG. 4 is a conventional outboard motor.

DETAILED DESCRIPTION OF THE PREFERRED EMBODIMENT

Referring to FIG. 1, marine propeller 10 is adapted to be fixed to a marine engine such an an outboard motor 12 as illustrated in FIG. 4 or an inboard-outboard engine (not shown). Propeller 10 is formed with hub means for associating a pluarlity of blades 14 to an engine shaft 16. The hub means is comprised of a central hub 18 which may be splined as at 20 to fit engine shaft 16. Mounted about central hub 18 is a mounting hub 22. Mounting hub 22 is affixed to central hub 18 by a plurality of vanes or webs 24 which may be formed helically as shown in FIG. 2 or may be formed as straight webs 24' in FIG. 3. The webs 24' should be noted are parallel to the axis of central hub 18'.

Exhaust gases from outboard motor 12 are directed downwardly and then rearwardly through a passage 26 to the chamber 28 formed between central hub 18 and mounting hub 22. The exhaust gases are for ultimate discharge through end 30 of marine propeller 10.

Affixed to end 30 is an extension 32 which forms the basis for this invention. Extension 32 has an inside dimension proximal end 30 substantially equal to the inside dimension of end 30. Extension 32 may be formed with a shoulder 34 and a sleeve-like extension 36 so that extension 32 may be mounted about mounting hub 22 in the manner shown in FIG. 2. Other means of mounting may be apparent to those skilled in the art.

The end of extension 32 distal of end 30 of propeller 10 has an inside dimension at least equal to and preferably greater than the inside dimension of end 30. This variation in dimension results in a venturi being formed in the chamber 28 thus assisting in scavaging the engine of exhaust gases.

Similarly the outside dimensions of extension 32 proximal end 30 is preferably at least equal to the outside dimension of end 30 while the outside dimension of extension 32 distal end 30 is preferably greater than the outside dimension of end 30.

On the inner surface 38 of extension 32 are a plurality of inwardly projecting helical fins 40. It is appropriate that there be at least two such fins as a single fin could serve to unbalance the propeller. Each of these fins should have a pitch generally equal to the pitch of the propeller.

The inwardly projecting helical fins as indicated in FIG. 2 project inwardly of chamber 28 to meet each web 24. In order to conform extension 32 with the integrally formed fins 40 to specific marine propellers 10 the inwardly extending fins can be made of a dimension so that each extension may be fitted individually to each propeller by appropriate cutting of the metal of the like. The radial height d (See FIG. 1) of each fin 40 that the fin extends inwardly form inner surface 38 preferably is generally equal to the distance d' separating mounting hub 22 from central hub 18 as shown in FIG. 2. The result being that webs 24 and fins 40 form one continuous structure from end 42 of marine propeller 10 (proximal engine shaft 16) to the end of extension 32 (distal of the propeller).

In operation, the extension 32 is affixed to mounting hub 22 in a manner as shon in FIG. 2 or a similar manner. Fastening may be accomplished by welding, brazing, soldering or the like with appropriate polishing occurring after the fastening. Alternatively set screws with socketed heads may be used. Referring now to FIG. 1, marine propeller 10 normally rotates in a clockwise direction as indicated in FIG. 1 thus exhause gas will operate first on webs 24 and finally on fins 40 while passing outwardly from passage 26. Such impingement on the webs and fins coupled with the venturi effect caused by the flaring of extension 32 tends to increase engine efficiency of the outboard engine 12.

Reference is now made to FIG. 3 wherein an extension 32' is affixed to propeller 10' which has a straight through webs 24'. It can be seen that the structure in FIG. 3 adds the helical feature to the fins thus adding the extra efficiency of helical structure to the straight through web structure. In all other aspects, this second embodiment is the same as the previously described embodiment.

Other advantages should be apparent to those skilled in the art upon the study of the disclosure, the drawings and the appended claims.

What is claimed is:

1. In combination with a marine propeller in which the engine exhaust gases discharge through the hub, the hub mounting the propeller on the drive shaft an improvement comprising:

an annular ring extension adapted to be received about the hub of the marine propeller distal of the drive shaft said annular ring having an inside dimension proximal the hub substantially equal to the inside dimension of the hub and an inside dimension distal the hub at least equal to the inside dimension of the hub, said annular ring extension having at least two inwardly projecting helical fins.

2. The improvement of claim 1 wherein the inwardly projecting helical fins are adapted to extend into the hub of the marine propeller.

3. The improvement of claim 1 wherein the pitch of the helical fins is generally equal to the pitch of the associated propeller.

4. The improvement of claim 1 wherein the inwardly projecting helical fins extend from the end distal of the propeller hub and further are adapted to extend into the hub of the marine propeller.

5. In a marine propeller having a shaft receiving central hub and a blade mounting hub concentrically mounted about the central hub by radially extending vanes thereby permitting exhaust gases to flow therebetween an improvement comprising:

an annular ring adapted to be received about the hub of a marine propeller distal of the drive shaft, said annular ring having an inside dimension proximal the hub substantially equal to the inside dimension of the hub and an inside dimension distal of the hub at least equal to the inside dimension of the hub said annular ring extension having at least two inwardly projecting helical fins;

said inwardly projecting helical fins formed to meet generally in an end to end relation with the radially extending vanes mounting the mounting hub concentrically about the center hub.

* * * * *

UNITED STATES PATENT AND TRADEMARK OFFICE

CERTIFICATE OF CORRECTION

PATENT NO. : 4,212,586

DATED : July 15, 1980

INVENTOR(S) : MERVYN F. AGUIAR

It is certified that error appears in the above—identified patent and that said Letters Patent is hereby corrected as shown below:

At Column 1, line 18, changes "system" to "systems."
At Column 1, line 20, change "exhause" to "exhaust."
At Column 1, line 33, between "gear" and "shaft" insert "and."
At Column 2, line 20, change "pluarlity" to "plurality."
At Column 2, line 65, change "metal of" to "metal or."
At Column 3, line 14, change "exhause" to "exhaust."

Signed and Sealed this

*Fourth* Day of *November 198(*

[SEAL]

*Attest:*

SIDNEY A. DIAMOND

*Attesting Officer*

*Commissioner of Patents and Trademark*